United States Patent [19]

Hamacher

[11] Patent Number: 4,845,806

[45] Date of Patent: Jul. 11, 1989

[54] SUSPENDED SLIDING PARTITION

[76] Inventor: Walter Hamacher, Birkengrund 2, 5100 Aachen, Fed. Rep. of Germany

[21] Appl. No.: 120,119

[22] Filed: Nov. 13, 1987

[30] Foreign Application Priority Data

Nov. 22, 1986 [DE] Fed. Rep. of Germany ... 8631316[U]

[51] Int. Cl.[4] ..... E05D 15/06

[52] U.S. Cl. ..... 16/88; 16/89; 16/91; 16/102; 16/106; 104/94

[58] Field of Search ..... 16/89, 90, 91, 93 R, 16/93 D, 102, 106, 88; 104/93, 94, 107, 108, 109, 106, 243, 245, 247, 242; 105/155, 156

[56] References Cited

U.S. PATENT DOCUMENTS

| | | | |
|---|---|---|---|
| 3,462,792 | 8/1969 | Greco | 104/94 |
| 3,879,799 | 4/1975 | Williams | 16/89 |
| 3,916,797 | 11/1975 | Block et al. | 104/109 |
| 4,141,106 | 2/1979 | Dixon | 16/89 |
| 4,401,033 | 8/1983 | Gerken | 16/89 |

*Primary Examiner*—Richard K. Seidel

*Attorney, Agent, or Firm*—David C. Purdue; John C. Purdue

[57] ABSTRACT

With a suspended sliding partition with a level track (1) and at least one panel-like element (3) is provided an upper mounting rail (4) which is suspended from the track (1) by two carrying bolts (2) which extend through a continuous slot in the underside of the track (1) into the latter and are there each connected to a carrying device (26, 27, 28, 40) which is supported in the track (1). The track (1) has two guide channels (12, 20) arranged at a distance one above the other and provided with lateral guiding surfaces (13, 21) on both sides, as well as a level supporting surface (17). On each carrying bolt (2) are mounted two lateral guiding elements (23, 30, 33, 34) which are guided in one of the guide channels (12, 20), as well as the carrying device (26, 27, 28, 40) which is supported on the supporting surface (17). The carrying device may be constructed as a plate (26, 40) which is fixed rigidly or pivotably to the carrying bolt (2) and which is provided with at least two balls (28) which roll over the supporting surface (17).

23 Claims, 3 Drawing Sheets

SUSPENDED SLIDING PARTITION

Figure 1:
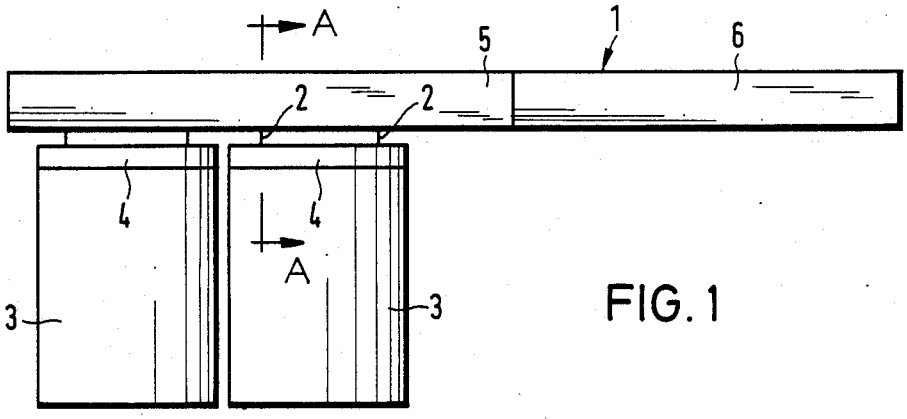

The invention relates to a suspended sliding partition with an upper track and at least one panel-like partition element which in each case has an upper mounting rail which is suspended from the track by two carrying bolts which extend through a continuous slot in the underside of the track into the latter and are there each connected to a carrying device which is supported in the track.

In suspended sliding partitions of this kind, it is required that they provide sufficient stability without the use of floor guide rails. It follows that in the case of these sliding partitions, the partition elements must be fixed exclusively by their support in the track in such a way that the required lateral stability is provided and the possibility of undesirable pivoting in a lateral direction is excluded. For this purpose is known the technique of associating with each carrying bolt four rollers whose axes extend parallel to the axis of the carrying bolt. Every two of these rollers are arranged in the same plane. The lower pair of rollers is supported by each roller edge on a supporting surface which slopes down towards the centre of the track. The lower rollers must assume a lateral guiding and carrying function, while the upper rollers serve for lateral guiding only.

The known device is elaborate in its structure. Absorption of the carrying forces by the edges of the rollers alone means that high wear can be expected.

The object of the present invention consists of providing a suspended sliding partition of the kind mentioned hereinbefore which at low cost of construction ensures reliable absorption of lateral guiding and carrying forces and at the same time can be moved around bends and corners.

According to the invention, in a suspended sliding partition of the kind mentioned hereinbefore this object is achieved by the fact that the track comprises two guide channels arranged at a distance one above the other and provided with lateral guiding surfaces on both sides, as well as a level supporting surface, and on each carrying bolt are mounted two lateral guiding elements which are each guided in a guide channel by the lateral guiding surfaces thereof, as well as a carrying device which is supported on the supporting surface.

Consequently, in the suspended sliding partition according to the invention there is a clear distinction between the components which serve for lateral guiding and those which take up the carrying loads. This results in optimum carrying of load, with a simple construction.

The suspended sliding partition according to the invention may be constructed in such a way that the track is a metal profile member which is in one piece in cross-section. There may be used an extruded profile which can easily be fixed in a known manner e.g. to a ceiling and adjusted.

The suspended sliding partition according to the invention may furthermore be constructed in such a way that the track consists of several track pieces adjoining each other in alignment or at an angle.

The suspended sliding partition according to the invention may furthermore be constructed in such a way that the supporting surface is disposed between the two guide channels, as seen in the axial direction of the carrying bolts.

According to a further proposal, the suspended sliding partition according to the invention may be constructed in such a way that one of the guide channels extends in the lower region of the track and the other is the upper region. This results in a particularly large gap between the components which serve for lateral guiding. The forces arising in connection therewith can in this case be absorbed particularly advantageously and reliably. The play which occurs here can be kept particularly low.

According to a further proposal, the suspended sliding partition according to the invention may be constructed in such a way that the lateral guiding surfaces of the guide channels extend parallel to each other. This produces a profile which is particularly easy to manufacture.

According to a further proposal, the suspended sliding partition according to the invention may be constructed in such a way that at least one lateral guiding element of each carrying bolt is formed by a guide ring mounted rotatably on the carrying bolt. A slight clearance between the diameter of the guide rings and the width of the guide channels can have the desirable result that in each case the guide rings abut against only one side surface of the respective guide channel, depending on the direction of load of the partition element. The guide rings may be made of a hard metal or plastics materials.

According to a further proposal, the suspended sliding partition according to the invention may be constructed in such a way that at least one lateral guiding element is formed by a guide portion mounted non-rotatably on the carrying bolt. This further simplifies construction. Instead of the rolling friction when using guide rings, here there is sliding friction where non-rotatably mounted guide portions are used.

According to a further proposal, the suspended sliding partition according to the invention may be constructed in such a way that the carrying device comprises a plate which is fixed to the carrying bolt and in which are mounted at least two balls which roll over the supporting surface. The number of balls can be adapted to the respective requirements. In particular, in this case it can be ensured that the individual partition elements can also be displaced parallel to each other, without absorption of the carrying forces becoming critical.

Finally, according to a further proposal of the invention, the suspended sliding partition may be constructed in such a way that the plate is supported pivotably on the carrying bolt. Pivotability is therefore advantageously limited in such a way that the balls are supported with load-bearing capacity even in case of dimensional variations, deformation and the like.

Three practical examples of the suspended sliding partition according to the invention are described in the following part of the specification with reference to drawings.

Figure 2:
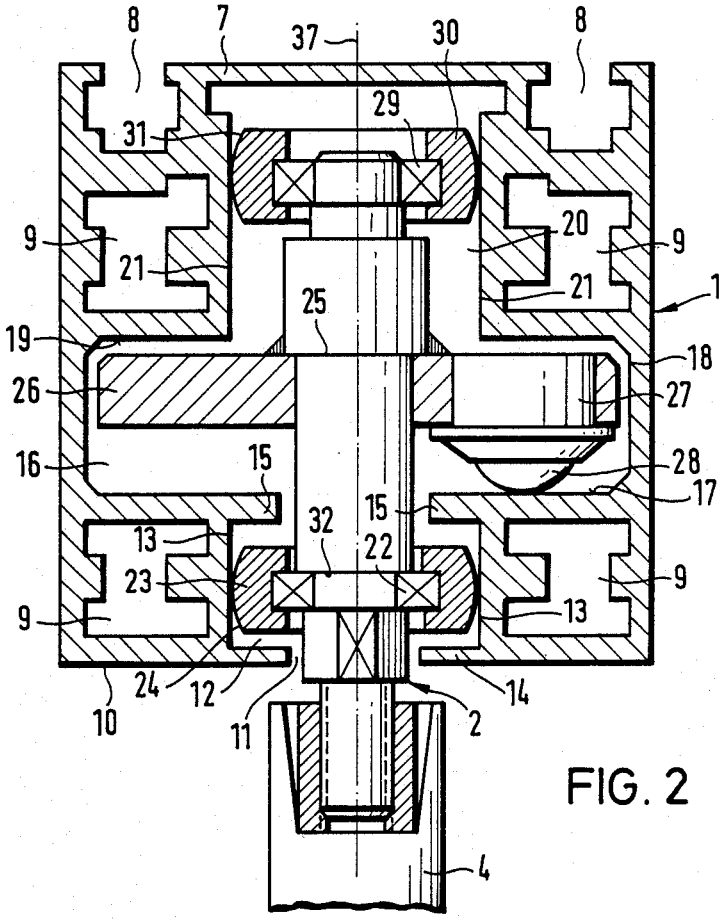
Figure 3:
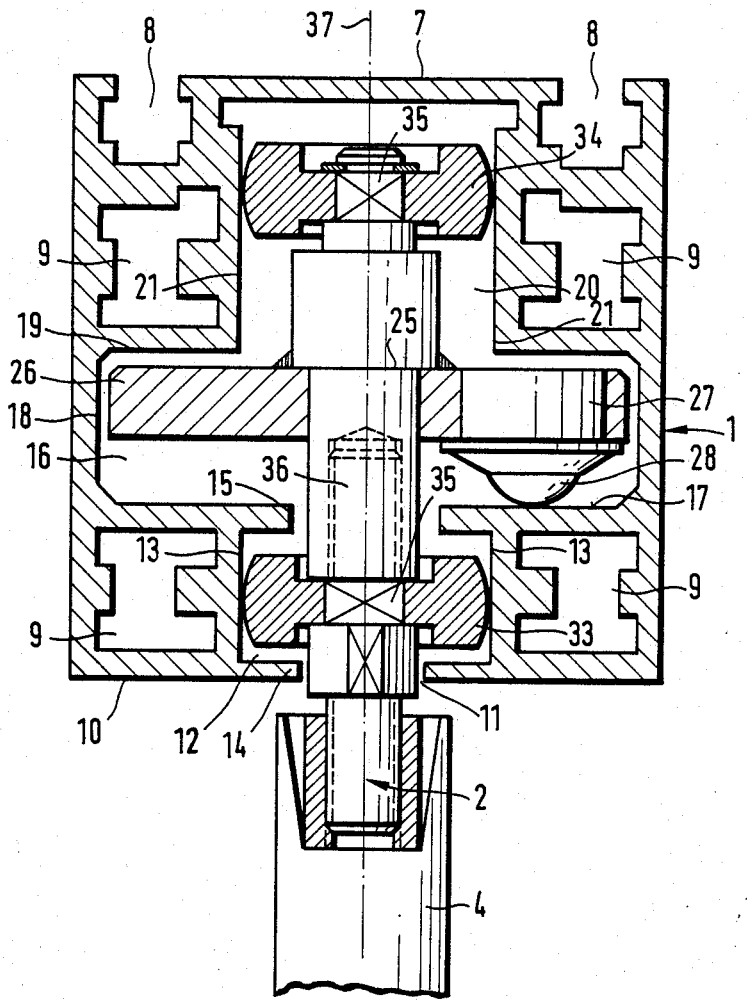
Figure 4:
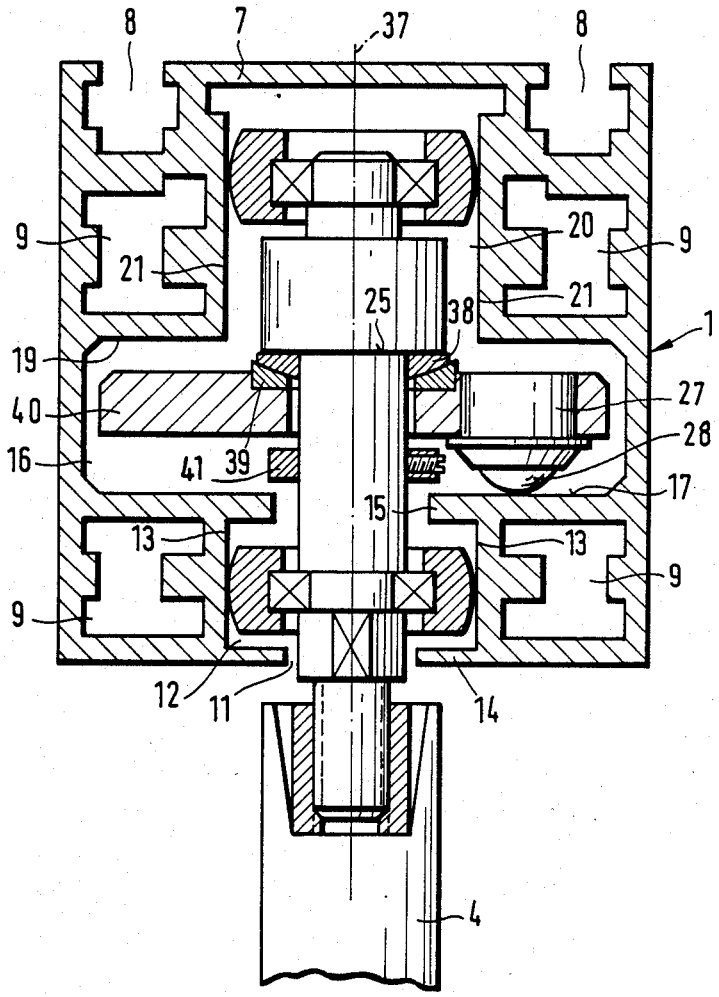

FIG. 1 shows a side view of a suspended sliding partition according to the invention, with two partition elements, FIG. 2 shows a section through line A—A in FIG. 1 according to a first embodiment, FIG. 3 shows a section through line A—A in FIG. 1 according to a second embodiment, and FIG. 4 shows a section through line A—A in FIG. 1 according to a third embodiment.

The suspended sliding partition according to FIG. 1 shows a track 1 from which is suspended, in each case by two carrying bolts 2, a partition element 3 which comprises an upper mounting rail 4. The track 1 is composed of two track pieces 5, 6 in the direction of rolling.

In the embodiments according to FIGS. 2 and 3, the track 1 is rectangular in cross-section. In its upper side 7 it comprises holding grooves 8 which serve to mount the track on a ceiling or the like. It is furthermore provided with additional cavities 9. In its lower side 10 it comprises a slot 11 which extends continuously in the longitudinal direction of the track 1 and which and is adjoined above, in the interior of the track 1, by a lower guide channel 12 which is bounded by lateral guiding surfaces 13 extending parallel to each other and by a lower end piece 14 and an upper end piece 15.

On the other side of the upper end piece 15, the lower guide channel 12 is adjoined by a cavity 16 which has a level supporting surface 17. It is furthermore bounded by an outer surface 18 and a top surface 19.

The cavity 16 is adjoined above by an upper guide channel 20 which also comprises lateral guiding surfaces 21 extending parallel to each other.

The profile of the track 1 is constructed symmetrically with respect to a plane passing through the axis 37. This means that the two guide channels 12, 20 and the cavity 16 with its supporting surface 17 extend in the same way on both sides of the above-mentioned plane.

Into the mounting rail 4 are screwed two carrying bolts 2 which are constructed and connected in the same way and of which only one is shown in FIG. 2. A ball bearing 22 is seated on a shoulder 32 on the carrying bolt 2. On the ball bearing 22 in turn is mounted a guide ring 23 whose outer surface 24 is convex. The maximum diameter of the guide ring 23 is slightly less than the distance between the lateral guidng surfaces 13 of the lower guide channel 12. The axial distance between the surfaces of the lower end piece 14 and upper end piece 15 which face towards each other, is considerably larger than the width of the guide ring 23.

A plate 26 is fixed to a further shoulder 25 of the carrying bolt 2. This plate 26 carries, by means of sockets 27. e.g. six balls 28 which roll over the supporting surface 17 which extends on both sides of the carrying bolt 2. The cavity 16 provides no guide means for the plate 26.

The carrying bolt 2 carries at its upper end which extends furthest into the track 1, a ball bearing 29 on which is rotatably mounted a guide ring 30 which has a convex outer surface 31. The maximum diameter of the guide ring 30 is slightly less than the distance between the lateral guiding surfaces 21 of the upper guide channel 20.

The embodiment according to FIG. 3 differs from the one according to FIG. 2 only in that no freely rotatable guide ring is disposed on the carrying bolt 2 in the lower guide channel 12 or in the upper guide channel 20, but according to this embodiment in the lower guide channel 12 is disposed an annular guide portion 33 which is mounted rigidly on the carrying bolt 2. Correspondingly, on the upper end of the carrying bolt 2 is also rigidly mounted a guide portion 34. The contour of the guide portions 33, 34 essentially corresponds to the previously described contour of the guide rings 23, 30. The guide portions 33, 34 are each mounted on square sections 35 of the carrying bolt 2.

FIG. 3 makes it clear that the carrying bolt 2 has a threaded pin 36 whose lower end is screwed into the mounting rail 4 and whose upper end is screwed into th carrying bolt 2.

The embodiment according to FIG. 4 differs from the one according to FIG. 2 only in that a carrying plate 40 is mounted with radial play on the carrying bolt 2 and supported by two ball sockets 38, 39 on the shoulder 25 of the carrying bolt 2. The carrying plate 40 is mounted with balls 28, as was already described for the above-mentioned embodiments. When the supporting surface 17 is not in the nominal position, the ball sockets 38, 39 move relative to each other and thus permit tilting of the carrying plate 40 relative to the carrying bolt 2, so that the balls 28 then too act upon the supporting surface 17 in a load-bearing relationship.

I claim:

1. Suspended sliding partition with an upper track and at least one panel-like partition element which in each case has an upper mounting rail which is suspended from the track by two carrying bolts which extend through a continuous slot in the underside of the track into the latter and are there connected to a carrying device which is supported in the track, characterised in that the track (1) comprises two guide channels (12, 20) arranged at a distance one above the other and provided with lateral guiding surfaces (13, 21) on both sides, as well as a level supporting surface (17) , and on each carrying bolt (2) are mounted two lateral guiding elements (23, 30; 33, 34) which are each guided in a guide channel (12, 20) by the lateral guiding surfaces thereof (13, 21) , as well as a carrying device (26, 27, 28, 40) which is supported on the supporting surface (17) , wherein coaction between the lateral guiding elements (23, 30; 33, 34) and the lateral guiding surfaces (12, 20) prevents the bolt (2) on which said guiding elements (23, 30; 33, 34) are mounted, from pivoting laterally with respect to the track (1).

2. Suspended sliding partition according to claim 1, characterised in that the track (1) is a metal profile member which is in one piece in cross-section.

3. Suspended sliding partition according to claim 1 or 2, characterised in that the track (1) consists of several track pieces (5, 6) adjoining each other in alignment or at an angle.

4. Suspended sliding partition according to claim. 3, characterised in that the supporting surface (17) is disposed between the two guide channels (12, 20), as seen in the axial direction of the carrying bolts (2).

5. Suspended sliding partition according to claim 1, characterised in that the supporting surface (17) is disposed between the two guide channels (12, 20), as seen in the axial direction of the carrying bolts (2).

6. Suspended sliding partition according to claim 1 or 5, characterised in that one of the guide channels (12, 20) extends in the lower region of the track (1) and the other one extends in the upper region of the track.

7. Suspended sliding partition according to claim 6, characterised in that the lateral guiding surfaces (13, 21) of the guide channels (12, 20) extend parallel to each other.

8. Suspended sliding partition according to claim 6, characterised in that at least one lateral guiding element (23, 30) of each carrying bolt (2) is formed by a guide ring mounted rotatably on the carrying bolt (2).

9. Suspended sliding partition according to claim 6, characterised in that at least one lateral guiding element (33, 34) is formed by a guide portion mounted nonrotatably on the carrying bolt (2).

10. Suspended sliding partition according to claim 6, characterised in that the carrying device comprises a plate (26; 40) which is fixed to the carrying bolt (2) and in which are mounted at least two balls (28) which roll over the supporting surface (17).

11. Suspended sliding partition according to claim 1, 2 or 5, characterised in that the lateral guiding surfaces (13, 21) of the guide channels (12, 20) extend parallel to each other.

12. Suspended sliding partition according to claim 11, characterised in that at least one lateral guiding element (23, 30) of each carrying bolt (2) is formed by a guide ring mounted rotatably on the carrying bolt (2).

13. Suspended sliding partition according to claim 11, characterised in that at least one lateral guiding element (33, 34) is formed by a guide portion mounted nonrotatably on the carrying bolt (2).

14. Suspended sliding partition according to claim 11, characterised in that the carrying device comprises a plate (26; 40) which is fixed to the carrying bolt (2) and in which are mounted at least two balls (28) which roll over the supporting surface (17).

15. Suspended sliding partition according to claim 1, 2 or 5, characterised in that at least one lateral guiding element (23, 30) of each carrying bolt (2) is formed by a guide ring mounted rotatably on the carrying bolt (2).

16. Suspended sliding partition according to claim 15, characterised in that the carrying device comprises a plate (26; 40) which is fixed to the carrying bolt (2) and in which are mounted at least two balls (28) which roll over the supporting surface (17).

17. Suspended sliding partition according to claim 1, 2 or 5, characterised in that at least one lateral guiding element (33, 34) is formed by a guide portion mounted nonrotatably on the carrying bolt (2).

18. Suspended sliding partition according to claim 17, characterised in that the carrying device comprises a plate (26; 40) whcih is fixed to the carrying bolt (2) and in which are mounted at least two balls (28) which roll over the supporting surface (17).

19. Suspended silding partition according to claim 1, 2 or 5, characterised in that the carrying device comprises a plate (26; 40) which is fixed to the carrying bolt (2) and in which are mounted at least two balls (28) which roll over the supporting surface (17).

20. Suspended sliding partition according to claim 19, characterised in that the plate (40) is supported pivotably on the carrying bolt (2).

21. A sliding partition suspension system for supporting at least one partition for sliding movement in a substantially vertical plane, said system comprising a track adapted to be mounted on a static structure, said track comprising an upper guide channel including two opposed guide surfaces, a lower guide channel including two opposed guide surfaces, a support surface disposed between said upper and lower guide channels, and slot means for defining a continuous slot wherein, when said track is mounted on a static structure, said guide surfaces are oriented substantially vertically, said support surface is oriented substantially horizontally, and the continuous slot is on the underside of said track and partition suspension means comprising a plurality of shafts, first mounting means carried at one end of each of said shafts for engaging a portion of a sliding partition and second mounting means carried at the other end of each of said shafts, said last named means comprising upper and lower lateral guiding elements supported on said shaft, said elements being operable, in conjunction with the lateral guide surfaces, to prevent the shaft on which said guiding elements are mounted, from pivoting laterally with respect to the track, and a support device secured to each of said shafts between said guiding elements for engaging said support surface and supporting the shafts relative thereto.

22. The suspension system of claim 21 including mounting means for supporting said shafts on said support devices for limited pivotal movement relative thereto.

23. Suspended sliding partiton with an upper track and at least one panel-like partition element which in each case has an upper mounting rail which is suspended from the track by two carrying bolts which extend through a continuous slot in the underside of the track into the latter and are there connected to a carrying device which is supported in the track, characterised in that the track (1) comprises a first guide channel (12) in a lower region of the track, said first guide channel including a first pair of lateral guiding surfaces (13) on each side thereof, a second guide channel (20) in an upper region of the track, said second guide channel including a second pair of lateral guiding surfaces (21) , said second pair of lateral guiding surfaces being parallel to said first pair of lateral guiding surfaces, and a level supporting surface (17) positioned between said first and said second guide channels, and further characterised in that, on each carrying bolt (2) are mounted first and second lateral guiding elements (23, 30; 33, 34) guided, respectively in said first and second guide channels (12, 20) by said first and second lateral guiding surfaces thereof (13, 21), and a carrying device (26, 27, 28, 40) which is supported on the supporting surface (17), wherein coaction between the lateral guiding elements (23, 30; 33, 34) and the lateral guiding surfaces (12, 20) prevents the bolt (2) on which said guiding elements (23, 30; 33, 34) are mounted, from pivoting laterally with respect to the track (1).

* * * * *